US010087950B2

(12) United States Patent
Nakaniwa et al.

(10) Patent No.: US 10,087,950 B2
(45) Date of Patent: Oct. 2, 2018

(54) CENTRIFUGAL ROTATION MACHINE

(71) Applicant: MITSUBISHI HEAVY INDUSTRIES COMPRESSOR CORPORATION, Tokyo (JP)

(72) Inventors: Akihiro Nakaniwa, Tokyo (JP); Ryosuke Saito, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 72 days.

(21) Appl. No.: 14/650,815

(22) PCT Filed: Nov. 25, 2013

(86) PCT No.: PCT/JP2013/081656
§ 371 (c)(1),
(2) Date: Jun. 9, 2015

(87) PCT Pub. No.: WO2014/115417
PCT Pub. Date: Jul. 31, 2014

(65) Prior Publication Data

US 2015/0308453 A1 Oct. 29, 2015

(30) Foreign Application Priority Data

Jan. 28, 2013 (JP) ..... 2013-013728

(51) Int. Cl.
*F04D 17/12* (2006.01)
*F04D 29/44* (2006.01)
(Continued)

(52) U.S. Cl.
CPC ..... *F04D 29/444* (2013.01); *F04D 17/122* (2013.01); *F04D 29/053* (2013.01);
(Continued)

(58) Field of Classification Search
CPC .... F04D 17/12; F04D 17/122; F04D 29/4206; F04D 29/441
See application file for complete search history.

(56) References Cited

U.S. PATENT DOCUMENTS 7,255,530 B2 * 8/2007 Vogiatzis ..... F01D 5/141 415/159
8,075,260 B2 * 12/2011 Aki ..... F04D 29/445 415/199.2
2010/0272564 A1 10/2010 Richter et al.

FOREIGN PATENT DOCUMENTS

BE 635536 A 11/1963
CN 101042144 A 9/2007
(Continued)

OTHER PUBLICATIONS

Office Action dated Jun. 2, 2016 in Counterpart Chinese Application No. 201380058827.1 with English Translation of part of Search Report.

(Continued)

*Primary Examiner* — Logan Kraft
*Assistant Examiner* — Sabbir Hasan
(74) *Attorney, Agent, or Firm* — Birch, Stewart, Kolasch & Birch, LLP

(57) ABSTRACT

A centrifugal rotation machine includes a rotation shaft, a plurality of impellers rotating along with the rotation shaft, a casing defining a return flow channel configured to guide the fluid from the front-stage impeller to the rear-stage impeller, and a plurality of return vanes installed in the return flow channel, the return flow channel includes a return bend section guiding the fluid G, which has been sent from the front-stage impeller to the outside in the radial direction, to the inside in the radial direction, the return bend section includes a first curved portion and a second curved portion connected to the downstream side of the first curved portion, (Continued)

and the radius of curvature of an inside wall surface of the second curved portion in the radial direction is greater than the radius of curvature of an inside wall surface of the first curved portion in the radial direction.

5 Claims, 5 Drawing Sheets

(51) Int. Cl.
*F04D 29/053* (2006.01)
*F04D 29/28* (2006.01)
*F04D 29/42* (2006.01)

(52) U.S. Cl.
CPC ..... *F04D 29/286* (2013.01); *F04D 29/4206* (2013.01); *F04D 29/441* (2013.01); *F05D 2240/121* (2013.01); *F05D 2250/70* (2013.01)

(56) References Cited

FOREIGN PATENT DOCUMENTS

| | | | | |
|---|---|---|---|---|
| JP | 4-66392 | U | | 6/1992 |
| JP | 9-4599 | A | | 1/1997 |
| JP | 10-331793 | A | | 12/1998 |
| JP | 11-72100 | A | | 3/1999 |
| JP | 11-173299 | A | | 6/1999 |
| JP | 2010-216456 | A | | 9/2010 |
| JP | 2010216456 | A | * | 9/2010 |
| JP | 2012-102712 | A | | 5/2012 |
| JP | 2012102712 | A | * | 5/2012 |

OTHER PUBLICATIONS

International Search Report and Written Opinion of the International Searching Authority, dated Feb. 25, 2014, for International Application No. PCT/JP2013/081656, together with an English translation thereof.

Extended European Search Report, dated Aug. 16, 2016, for European Application No. 13872387.9.

* cited by examiner

CENTRIFUGAL ROTATION MACHINE

TECHNICAL FIELD

The present invention relates to a centrifugal rotation machine such as a centrifugal compressor that compresses gas using a centrifugal force.

Priority is claimed on Japanese Patent Application No. 2013-013728, filed Jan. 28, 2013, the content of which is incorporated herein by reference.

BACKGROUND ART

As is widely known, a centrifugal compressor functions to pass a gas in a radial direction of a rotating impeller and to compress a fluid such as the gas using a centrifugal force generated at that time. As such a centrifugal compressor, a multistage centrifugal compressor which includes impellers in multiple stages in an axial direction thereof and compresses a gas stepwise is known (see Patent Literature 1). The multistage centrifugal compressor will be described in brief with reference to an accompanying drawing.

As shown in FIG. 6, a compressor 101 includes a casing 5 in which an inlet and an outlet not shown are formed, a rotation shaft 2 that is rotatably supported by the casing 5 with a bearing section (not shown) interposed therebetween, a plurality of impellers 3 that are attached at predetermined intervals along the axial direction of the rotation shaft 2, and a flow channel 4 that connects the impellers 3 to cause a gas which is compressed stepwise to flow. The casing 5 includes a shroud casing 5*a* and a hub casing 5*b*.

Each impeller 3 mainly includes a disc-like hub 13 of which the diameter is gradually enlarged to one side (rear stage side) in the axial direction, a plurality of vanes 14 that are radially attached to the hub 13, and a shroud 15 that is attached to cover the tip sides of the plurality of vanes 14 in the circumferential direction.

The flow channel 4 includes a compression flow channel 17 and a return flow channel 118. The compression flow channel 17 is a flow channel which is defined by a vane attachment surface of the hub 13 and an inner wall surface of the shroud 15 facing the vane attachment surface. The return flow channel 118 includes a suction section 119, a diffuser section 120, and a return bend section 121.

The suction section 119 includes a straight channel 122 through which a gas flows from the outside in the radial direction to the inside in the radial direction and a curved corner channel 123 that converts the flow direction of a fluid flowing from the straight channel 122 into the axial direction of the rotation shaft 2 and guides the fluid to the impeller 3. The diffuser section 120 is a channel extending to the outside in the radial direction and causes a fluid compressed by the impeller 3 to flow to the outside in the radial direction. The return bend section 121 is a curved channel that converts the flow direction of the fluid passing through the diffuser section 120 into the inside in the radial direction and sends the fluid out to the suction section 119.

Accordingly, a fluid G sequentially flows through the first-stage suction section 119, the compression flow channel 17, the diffuser section 120, and the return bend section 121 and then sequentially flows through the second-stage suction section 119, the compression flow channel 17, . . . , whereby the fluid is compressed stepwise. The straight channel 122 of the suction section 119 is provided with a plurality of return vanes 125 that are radially arranged and that partition the straight channel 122 in the circumferential direction. The plurality of return vanes 125 are arranged over the entire width of the straight channel 122.

CITATION LIST

Patent Literature

[Patent Literature 1]

Japanese Unexamined Patent Application, First Publication No. Hei 9-4599

SUMMARY OF INVENTION

Technical Problem

However, in the conventional centrifugal compressor 101, there is a problem in that separation of the fluid G occurs on the hub casing 5*b* side of the entrance of the return vanes 125 (the inside in the radial direction) and a pressure loss is caused. That is, the pressure on the hub casing 5*b* side decreases due to the curvature of the return bend section 121 and the flow rate of the fluid G on the inside in the radial direction increases as indicated by reference sign β. Accordingly, a frictional loss increases, the separation of the fluid G occurs, uniformity of a flow in the entrance of the return vane 125 is disturbed, pressure recovery in a downstream part is not sufficient, and thus the efficiency of the centrifugal compressor is damaged.

The present invention provides a centrifugal rotation machine that can reduce a pressure loss in a return flow channel section of a centrifugal rotation machine such as a centrifugal compressor and achieve high efficiency.

Solution to Problem

According to a first aspect of the present invention, there is provided a centrifugal rotation machine including: a rotation shaft that rotates around an axis; a plurality of impellers that rotate along with the rotation shaft to send out a fluid; a casing that is installed to surround the rotation shaft and the plurality of impellers and defines a return flow channel configured to guide the fluid from the front-stage impeller to the rear-stage impeller; and a plurality of return vanes that are installed in the return flow channel at intervals in the circumferential direction of the axis, wherein the return flow channel includes a return bend section that guides the fluid, which has been sent out from the front-stage impeller to the outside in the radial direction, to the inside in the radial direction, wherein the return bend section includes a first curved portion and a second curved portion connected to the downstream side of the first curved portion, and wherein the radius of curvature of an inside wall surface of the first curved portion in the radial direction is greater than the radius of curvature of an inside wall surface of the first curved portion in the radial direction.

According to this configuration, since the flow rate of the fluid on the inside of the second curved portion in the radial direction is lowered, uniformity of the flow rate in the radial direction is achieved, and prevention of separation of the fluid is promoted, it is possible to reduce a pressure loss in the return flow channel of the centrifugal rotation machine.

In the centrifugal rotation machine, a leading edge of each return vane may be located in the second curved portion of the return bend section.

According to this configuration, since a dynamic pressure at an entrance of the return vane decreases, the uniformity in the flow rate of the fluid is improved, and the prevention of separation of the fluid is promoted, an impact loss with the return vane decreases and it is thus possible to reduce a pressure loss of the centrifugal rotation machine.

Since the fluid of which an average flow rate has decreased in the return bend section can be accelerated in the return vane by starting the return vane before the return bend section terminates, it is possible to improve rectification of the fluid.

In the centrifugal rotation machine, the leading edge of the return vane may be inclined downstream from the normal direction of the inside wall surface of the second curved portion in the radial direction as it approaches an outside wall surface of the second curved portion in the radial direction.

According to this configuration, even when uniformity in the flow rate of the fluid in the radial direction is improved but the flow rate on the inside in the radial direction is still high, it is possible to further decrease the flow rate of the fluid on the inside of the second curved portion in the radial direction by causing the inside of the leading edge in the radial direction to interfere with the fluid from the upstream side. By decreasing the flow rate of the fluid, it is possible to prevent separation of the fluid on the inside of the second curved portion in the radial direction.

In the centrifugal rotation machine, a flow channel width at an exit of the return bend section may be greater than a flow channel width at an entrance of the return bend section.

According to this configuration, since the flow rate of the fluid at the exit of the return bend section is further uniformized, the dynamic pressure at the entrance of the return vane decreases, and the impact loss with the return vane decreases, it is possible to further reduce the pressure loss of the centrifugal rotation machine.

Advantageous Effects of Invention

According to the present invention, it is possible to reduce a pressure loss in a return flow channel section of a centrifugal rotation machine such as a centrifugal compressor and thus to achieve high efficiency.

DESCRIPTION OF EMBODIMENTS

Hereinafter, embodiments of the present invention will be described in detail with reference to the accompanying drawings. In the embodiments, a multistage centrifugal compressor including a plurality of impellers will be described as an example of a centrifugal compressor.

Figure 1:
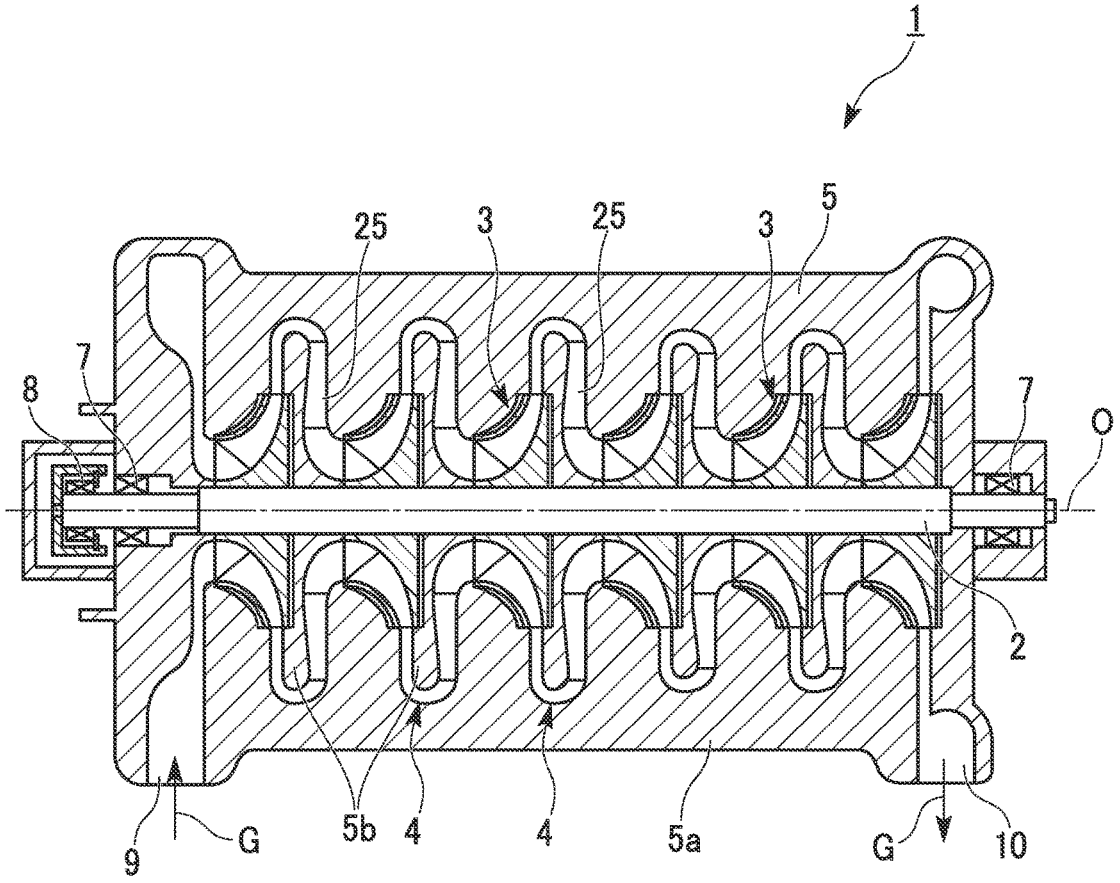
FIG. 1 is a diagram schematically showing a configuration of a centrifugal compressor according to an embodiment of the present invention.

As shown in FIG. 1, a centrifugal compressor 1 according to this embodiment mainly includes a rotation shaft 2 that rotates around an axis O, an impeller 3 that is attached to the rotation shaft 2 and that compresses a fluid G using a centrifugal force, and a casing 5 that rotatably supports the rotation shaft 2 and in which a flow channel 4 allowing the fluid G to flow from an upstream side to a downstream side is formed.

The casing 5 is formed to have a substantially cylindrical outline and the rotation shaft 2 is disposed to penetrate the center thereof. Journal bearings 7 are disposed at both ends in the axial direction of the rotation shaft 2 in the casing 5, and a thrust bearing 8 is disposed at one end thereof. The journal bearings 7 and the thrust bearing 8 rotatably support the rotation shaft 2. That is, the rotation shaft 2 is supported by the casing 5 with the journal bearings 7 and the thrust bearing 8 interposed therebetween.

An inlet 9 through which the fluid G flows from the outside is disposed at one end in the axial direction of the casing 5 and an outlet 10 through which the fluid G flows to the outside is disposed at the other end. In the casing 5, an internal space that communicates with the inlet 9 and the outlet 10 and of which reduction and extension in diameter are repeated is provided. The internal space functions as a space configured to accommodate the impeller 3 and also functions as the flow channel 4. That is, the inlet 9 and the outlet 10 communicate with each other via the impeller 3 and the flow channel 4. The casing 5 includes a shroud casing 5*a* and a hub casing 5*b* and the internal space is formed by the shroud casing 5*a* and the hub casing 5*b*.

A plurality of impellers 3 are arranged at intervals in the axial direction of the rotation shaft 2, and six impellers 3 are arranged in the shown example, it is only necessary that at least one impeller be arranged.

Figure 2:
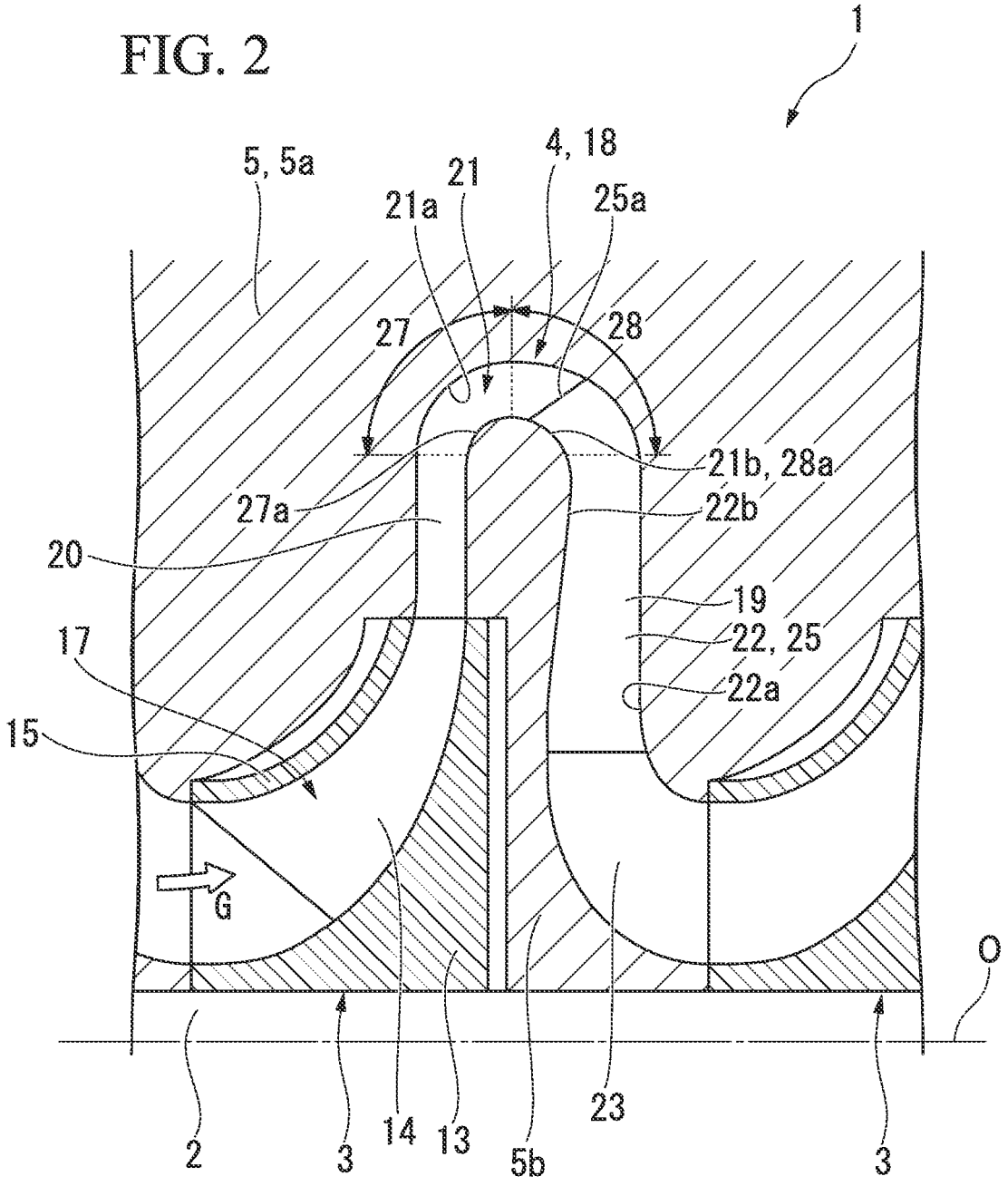
FIG. 2 is an enlarged view showing the periphery of impellers of the centrifugal compressor according to the embodiment of the present invention.

As shown in FIG. 2, each impeller 3 includes a substantially disc-like hub 13 of which the diameter increases toward the outlet 10 side, a plurality of vanes 14 that are radially attached to the hub 13 and that are arranged in the circumferential direction, and a shroud 15 that is attached to cover the tip side of the plurality of vanes 14 in the circumferential direction.

The flow channel 4 extends in the axial direction to connect the impellers 3 while meandering in the radial direction of the rotation shaft 2 to cause the plurality of impellers 3 to compress the fluid G stepwise. Specifically, the flow channel 4 includes a compression flow channel 17 and a return flow channel 18.

The return flow channel 18 is a flow channel that is disposed to surround the rotation shaft 2 and the plurality of impellers 3 and guides the fluid G from the front-stage impeller 3 to the rear-stage impeller 3, and includes a suction section 19, a diffuser section 20, and a return bend section 21.

The suction section 19 is a channel that causes the fluid G to flow from the outside in the radial direction to the inside in the radial direction and then changes the direction of the fluid G to the axial direction of the rotation shaft 2 just before the impeller 3. Specifically, the suction section includes a linear straight channel 22 through which the fluid G flows from the outside in the radial direction to the inside in the radial direction and a curved corner channel 23 that changes the flow direction of the fluid G flowing from the straight channel 22 from the inside in the radial direction to the axial direction and causes the fluid G to flow to the impeller 3.

The straight channel 22 is surrounded and defined by a hub-side flow channel wall surface 22*b* of the hub casing 5*b* and a shroud-side flow channel wall surface 22*a* of the shroud casing 5*a*. Here, in the straight channel 22 of the suction section 19 causing the fluid G to flow to the first-stage impeller 3, the outside in the radial direction thereof communicates with the inlet 9 (see FIG. 1).

The straight channel 22 located between two impellers 3 is provided with a plurality of return vanes 25 that are radially arranged about the axis O and that partitions the straight channel 22 in the circumferential direction of the rotation shaft 2.

The compression flow channel 17 is a part configured to compress the fluid G sent from the suction section 19 in the impeller 3 and is surrounded and defined by a vane attachment surface of the hub 13 and an inner wall surface of the shroud 15.

The inside in the radial direction of the diffuser section 20 communicates with the compression flow channel 17 and functions to cause the fluid G compressed by the impeller 3 to flow to the outside in the radial direction. The outside in the radial direction of the diffuser section 20 communicates with the return bend section 21, and the diffuser section 20 extending to the outside in the radial direction of the impeller 3 (the sixth-stage impeller 3 in FIG. 1) located furthest downstream in the flow channel 4 communicates with the outlet 10.

The return bend section 21 has a cross-section of a substantially U shape and is surrounded and defined by an inner circumferential wall surface of the shroud casing 5*a* and an outer circumferential wall surface of the hub casing 5*b*. That is, the inner circumferential wall surface of the shroud casing 5*a* forms an outside curved surface 21*a* of the return bend section 21 and the outer circumferential wall surface of the hub casing 5*b* forms an inner circumferential curved surface 21*b* of the return bend section 21.

The upstream end of the return bend section 21 communicates with the diffuser section 20, and the downstream end thereof communicates with the straight channel 22 of the suction section 19.

The return bend section 21 inverts the flow direction of the fluid G flowing to the outside in the radial direction through the diffuser section 20 by the impeller 3 (upstream impeller 3) to the inside in the radial direction and sends out the fluid to the straight channel 22.

Here, the return bend section 21 of this embodiment includes a first curved portion 27 and a second curved portion 28 connected to the downstream side of the first curved portion 27. The inner circumferential curved surface 21*b* of the return bend section 21 includes a first inner circumferential curved surface 27*a* of the first curved portion 27 and a second inner circumferential curved surface 28*a* of the second curved portion 28.

Figure 3:
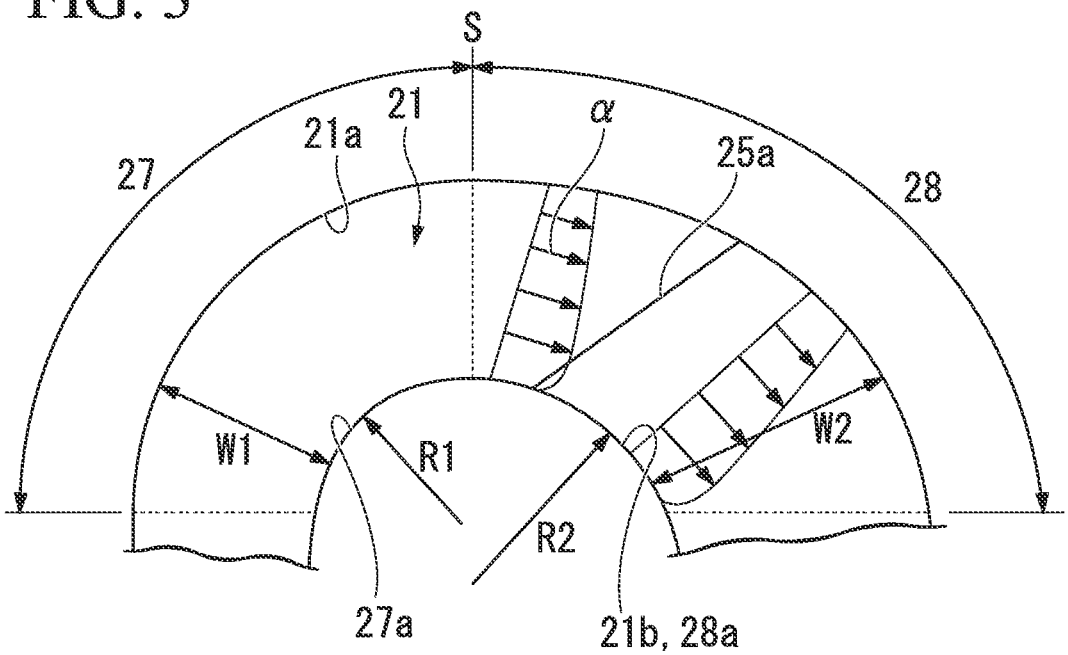
FIG. 3 is an enlarged view showing a return bend section of the centrifugal compressor according to the embodiment of the present invention.

As shown in FIG. 3, the radius of curvature R2 of the second inner circumferential curved surface 28*a* of the second curved portion 28 is greater than the radius of curvature R1 of the first inner circumferential curved surface 27*a* of the first curved portion 27. In other words, the radius of curvature R2 of the inside wall surface in the radial direction of the second curved portion 28 is greater than the radius of curvature R1 of the inside curved surface in the radial direction of the first curved portion 27. Preferably, the radius of curvature R2 of the second inner circumferential curved surface 28*a* of the second curved portion 28 is about twice the radius of curvature R1 of the first inner circumferential curved surface 27*a* of the first curved portion 27.

A start position S of the second inner circumferential curved surface 28*a* is preferably located at a position of the highest vertex on the outside in the radial direction of the inner circumferential curved surface 21*b* of the return bend section 21 or the vicinity thereof. In other words, the start position S of the second inner circumferential curved surface 28*a* is preferably located in the vicinity of the midpoint (position at which the flow direction is folded back 90°) of the return bend section 21 at which the flow direction of the fluid G is folded back 180°.

The flow channel width W2 at the exit of the return bend section 21 is greater than the flow channel width W1 at the entrance of the return bend section. The flow channel width may be gradually enlarged as shown in FIG. 2 or may be enlarged stepwise.

The flow channel width W2 need not be set to be greater than the flow channel width W1, and the same flow channel width may be maintained from the entrance to the exit of the return bend section 21.

A leading edge 25*a* (entrance end) of each return vane 25 of this embodiment is located in the second curved portion 28 of the return bend section 21. That is, the return vane 25 is formed to be longitudinal to the upstream side in comparison with the conventional return vane, such that the entrance end thereof passes over the shroud-side flow channel wall surface 22*a* and the hub-side flow channel wall surface 22*b* and reaches the return bend section 21.

The leading edge 25*a* of the return vane 25 is inclined downstream toward the outside curved surface 21*a* (the outside wall surface in the radial direction) of the second curved portion 28. In other words, the inside in the radial direction of the leading edge 25*a* protrudes upstream toward the hub casing 5*b* (inside in the radial direction).

The straight channel 22 of the return flow channel 18 of this embodiment has a shape that returns upstream from the hub-side flow channel wall surface 22*b*. That is, the hub-side flow channel wall surface 22*b* of the straight channel 22 is not parallel to the radial direction but is inclined in the upstream direction of the fluid G as it goes inside in the radial direction.

Compression of a fluid G in the centrifugal compressor 1 having the above-mentioned configuration will be described below.

When the impellers 3 rotate along with the rotation shaft 2, a fluid G flowing into the flow channel 4 from the inlet 9 sequentially flows from the inlet 9 through the suction section 19 of the return flow channel 18, the compression flow channel 17, the diffuser section 20, and the return bend section 21 of the first-stage impeller 3 and then sequentially flows through the suction section 19, the compression flow channel 17, . . . of the second-stage impeller 3.

The fluid G flowing to the diffuser section 20 just after the impeller 3 located furthest downstream in the flow channel 4 flows to the outside from the outlet 10.

The fluid G is compressed by the impellers 3 while flowing through the flow channel 4 in the above-mentioned order. That is, in the centrifugal compressor 1, the fluid G is compressed stepwise by the plurality of impellers 3 and it is thus possible to easily obtain a great compression ratio.

According to this embodiment, since the radius of curvature R2 of the second inner circumferential curved surface 28*a* (the inside wall surface in the radial direction) of the second curved portion 28 is greater than the radius of curvature R1 of the first inner circumferential curved surface 27*a* (the inside wall surface in the radial direction) of the first curved portion 27, the centrifugal force applied to the fluid G in the second curved portion 28 decreases. Accordingly, the flow rate of the fluid G on the inside in the radial direction of the second curved portion 28 decreases and uniformity in the flow rate in the radial direction is achieved. Since prevention of the separation of the fluid G is promoted, it is possible to reduce the pressure loss in the return flow channel 18 of the centrifugal compressor 1. Similarly to the inner circumferential curved surface 21*b*, the radius of curvature of the outer circumferential curved surface 21*a* is preferably greater on the second curved portion 28 side than on the first curved portion 27 side.

Since the leading edge 25*a* of the return vane 25 is located in the second curved portion 28 in the return bend section 21, the uniformity in the flow rate of the fluid G at the entrance of the return vane 25 can be guaranteed. That is, since the dynamic pressure at the entrance of the return vane 25 is reduced and the frictional loss with the return vane 25 is reduced, it is possible to reduce the pressure loss of the centrifugal compressor 1.

The leading edge 25*a* of the return vane 25 is inclined downstream from the normal direction of the inside wall surface in the radial direction of the second curved portion 28, that is, the second inner circumferential curved surface 28*a*, as it approaches the outside curved surface 21*a* (the outside wall surface in the radial direction). Accordingly, even when the flow rate on the inside in the radial direction is higher, it is possible to cause the inside of the leading edge 25*a* in the radial direction to interfere with the fluid from the upstream side. Accordingly, it is possible to further decrease the flow rate of the fluid G on the inside in the radial direction of the second curved portion 28. By decreasing the flow rate of the fluid G, it is possible to prevent separation of the fluid G on the inside of the second curved portion 28 in the radial direction.

Since the fluid G of which an average flow rate has decreased in the return bend section 21 can be accelerated in the return vane 25 by starting the return vane 25 before the return bend section 21 terminates, it is possible to improve rectification of the fluid G.

Since the flow channel width W2 at the exit of the return bend section 21 is greater than the flow channel width W1 at the entrance of the return bend section 21, the flow rate of the fluid G at the exit of the return bend section 21 is further uniformized. Accordingly, since the dynamic pressure at the entrance of the return vane 25 decreases and the impact loss with the return vane 25 decreases, it is possible to further reduce the pressure loss of the centrifugal compressor 1.

In comparison with the case in which the return vane 25 is disposed to start downstream from of the exit of the return bend section 21, the return vane 25 is disposed to start upstream from the exit. Accordingly, it is possible to elongate the return vane 25 to that extent and to enhance the acceleration effect in the return vane. Alternatively, it is possible to secure a predetermined length of the return vane to guarantee the effect thereof and to reduce the length in the radial direction, that is, in the height direction of the machine.

Since the straight channel 22 has a curved shape that returns to the hub-side flow channel wall surface 22*b* side, it is possible to secure the predetermined length of the flow channel and to reduce the length in the axial direction of the flow channel of the compressor. That is, it is possible to achieve compactness of the centrifugal compressor 1.

In the above-mentioned embodiment, the radius of curvature R2 of the second curved portion 28 is greater than the radius of curvature R1 of the first curved portion 27 in the return bend section 21 of all the stages of the multistage centrifugal compressor 1 and the leading edge 25*a* of the return vane 25 is located in the second curved portion 28, but the present invention is not limited to this configuration.

For example, in the return bend section 21 of some upstream stages (for example, upstream two stages) among five stages, the radius of curvature R2 of the second curved portion 28 may be greater than the radius of curvature R1 of the first curved portion 27 and the leading edge 25*a* of the return vane 25 may be located in the second curved portion 28.

In the upstream compressor stages, since the channel height is large and the flow in the height direction of the flow channel is likely to be distributed, the above-mentioned configuration is preferably applied thereto.

Figure 4:
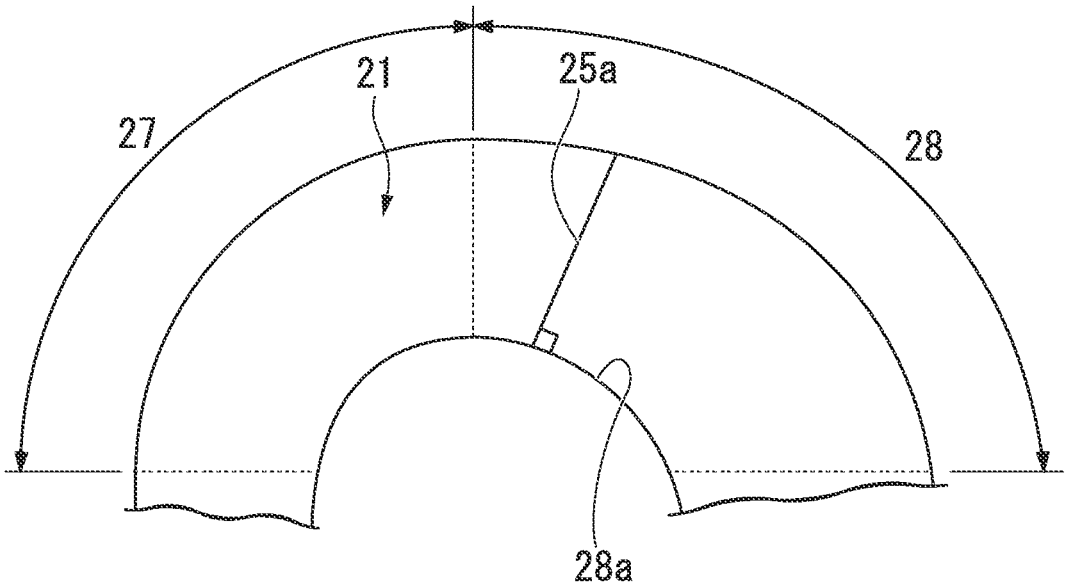
FIG. 4 is an enlarged view showing a return bend section of a centrifugal compressor according to a first modified example of the embodiment of the present invention.

In the above-mentioned embodiment, the leading edge 25*a* is inclined downstream as it approaches the outside wall surface in the radial direction, but for example, as in the first modified example shown in FIG. 4, the leading edge 25*a* may be formed to be parallel to the normal direction of the second inner circumferential curved surface 28*a*. This shape is effective when the uniformity in the flow rate of the fluid G is high. The leading edge may be substantially parallel to the axial direction.

Figure 5:
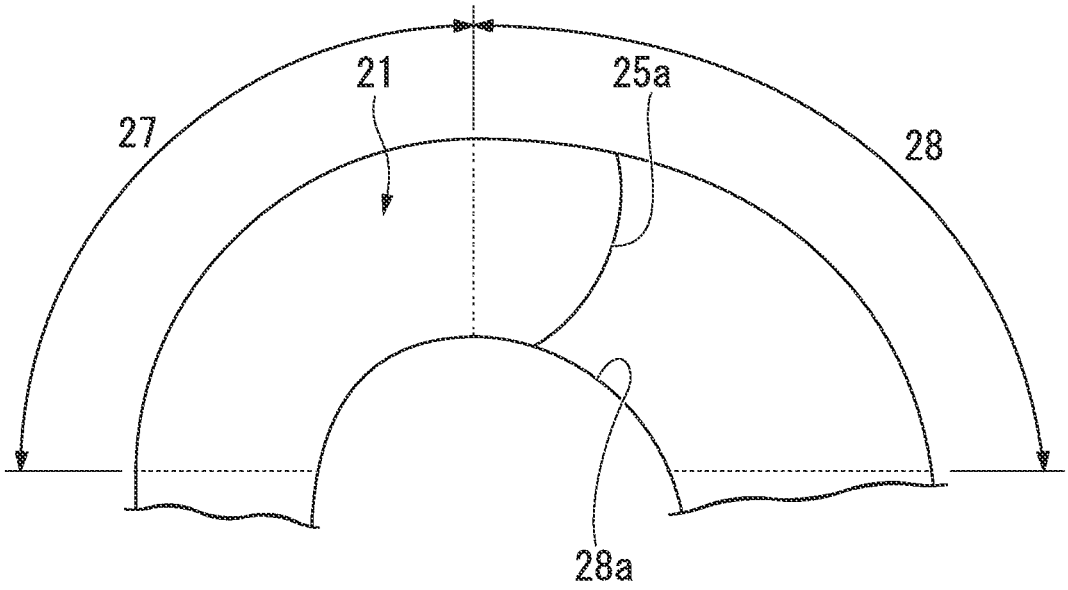
FIG. 5 is an enlarged view showing a return bend section of a centrifugal compressor according to a second modified example of the embodiment of the present invention.
Figure 6:
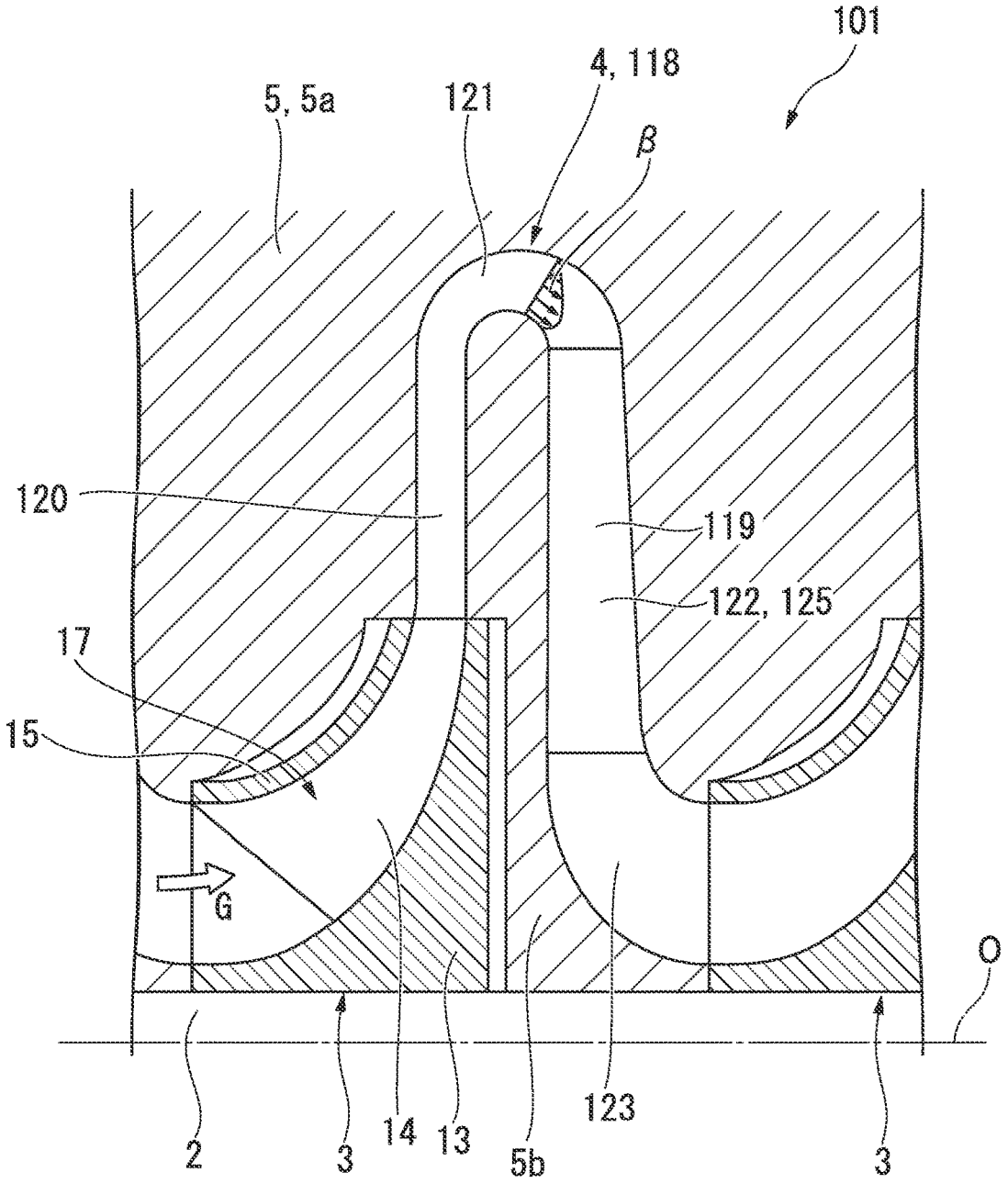
FIG. 6 is an enlarged view showing the periphery of impellers of a centrifugal compressor according to the related art.

In the above-mentioned embodiment, the leading edge 25*a* of the return vane 25 has a linear shape, but the present invention is not limited to this shape. For example, as in the second modified example shown in FIG. 5, the leading edge 25*a* may have a curved shape which is convex downstream. That is, the leading edge 25*a* may have a curved shape in which the vicinity of the center of the leading edge 25*a* is convex downstream.

The fluid tends to flow in a direction perpendicular to the leading edge 25*a*. By forming the leading edge 25*a* in a shape which is convex downstream, the flow of the fluid flowing into the return vane 25 tends to be directed to the wall surface in the vicinity of the wall surface. Since a force acting toward the wall surface suppresses separation of the flow from the wall surface, the loss due to the separation of the flow is reduced. Accordingly, it is possible to further reduce the pressure loss of the centrifugal compressor 1.

While embodiments of the present invention have been described in detail with reference to the accompanying drawings, the specific configuration is not limited to these embodiments and includes changes in design that do not departing from the gist of the present invention.

For example, in the above-mentioned embodiments, a so-called close impeller type impeller is used, but a so-called open impeller type impeller may be used.

The centrifugal rotation machine according to the present invention is not limited to the centrifugal compressor according to the above-mentioned embodiments, but can be appropriately applied to other configurations.

INDUSTRIAL APPLICABILITY

The present invention can be applied to a centrifugal rotation machine such as a centrifugal compressor that compresses a gas using a centrifugal force. According to the present invention, it is possible to reduce a pressure loss in a return flow channel of the centrifugal rotation machine.

REFERENCE SIGNS LIST

1 Centrifugal compressor
2 Rotation shaft
3 Impeller
4 Flow channel
5 Casing

5*a* Shroud casing
5*b* Hub casing
7 Journal bearing
8 Thrust bearing
9 Inlet
10 Outlet
13 Hub
14 Vane
15 Shroud
17 Compression flow channel
18 Flow channel
19 Suction section
20 Diffuser section
21 Return bend section
21*a* Outside curved surface
21*b* Inner circumferential curved surface
22 Straight channel
22*a* Shroud-side flow channel wall surface
22*b* Hub-side flow channel wall surface
23 Corner channel
25 Return vane
25*a* Leading edge
27 First curved portion
27*a* First inner circumferential curved surface
28 Second curved portion
28*a* Second inner circumferential curved surface
G Fluid
O Axis
R1 Radius of curvature
R2 Radius of curvature
W1 Flow channel width
W2 Flow channel width

The invention claimed is:

1. A centrifugal rotation machine comprising:

a rotation shaft that rotates around an axis;

a plurality of impellers that rotate along with the rotation shaft to send out a fluid; and a casing that is installed to surround the rotation shaft and the plurality of impellers and defines a return flow channel configured to guide the fluid from a front-stage impeller to a rear-stage impeller, wherein the return flow channel comprises:

a return bend section that guides the fluid, which has been sent out from the front-stage impeller in a radially outward direction, to a radially inward direction;

a diffuser section with which an upstream end of the return bend section communicates to cause the fluid sent out by one of the impellers to flow in the radially outward direction;

a straight channel with which a downstream end of the return bend section communicates to cause the fluid from an outside in the radial direction to an inside in the radial direction; and a plurality of return vanes that are installed over a region from the return bend section to the straight channel at intervals in the circumferential direction of the axis, wherein the return bend section includes a first curved portion and a second curved portion connected to the downstream side of the first curved portion, wherein a radius of curvature of an inside wall surface of the second curved portion in the radial direction is greater than a radius of curvature of an inside wall surface of the first curved portion in the radial direction, wherein a leading edge of each return vane is located in the second curved portion of the return bend section, and wherein the leading edge of each return vane is formed in a downstream convex shape.

2. The centrifugal rotation machine according to claim 1, wherein the leading edge of the return vane is inclined downstream from the normal direction of the inside wall surface of the second curved portion in the radial direction as it approaches an outside wall surface of the second curved portion in the radial direction.

3. The centrifugal rotation machine according to claim 2, wherein a flow channel width at an exit of the return bend section is greater than a flow channel width at an entrance of the return bend section.

4. The centrifugal rotation machine according to claim 1, wherein a flow channel width at an exit of the return bend section is greater than a flow channel width at an entrance of the return bend section.

5. The centrifugal rotation machine according to claim 1, wherein a front-stage side wall of the straight channel is inclined in the upstream direction of the flow as the front-stage side wall goes inside in the radial direction.

* * * * *